US010422217B2

(12) United States Patent
Ma et al.

(10) Patent No.: US 10,422,217 B2
(45) Date of Patent: Sep. 24, 2019

(54) ELECTROMAGNETICALLY COUPLED BAND-GAP TRANSCEIVERS

(71) Applicant: HALLIBURTON ENERGY SERVICES, INC., Houston, TX (US)

(72) Inventors: Jin Ma, Singapore (SG); Glenn Andrew Wilson, Singapore (SG); Iftikhar Ahmed, Singapore (SG); Li Pan, Singapore (SG)

(73) Assignee: Halliburton Energy Services, INC., Houston, TX (US)

( * ) Notice: Subject to any disclaimer, the term of this patent is extended or adjusted under 35 U.S.C. 154(b) by 123 days.

(21) Appl. No.: 15/516,722

(22) PCT Filed: Dec. 29, 2014

(86) PCT No.: PCT/US2014/072507

§ 371 (c)(1),
(2) Date: Apr. 4, 2017

(87) PCT Pub. No.: WO2016/108816

PCT Pub. Date: Jul. 7, 2016

(65) Prior Publication Data

US 2017/0298724 A1 Oct. 19, 2017

(51) Int. Cl.
*G01V 3/00* (2006.01)
*E21B 47/12* (2012.01)
(Continued)

(52) U.S. Cl.
CPC ..... *E21B 47/122* (2013.01); *E21B 47/024* (2013.01); *E21B 49/003* (2013.01); *E21B 4/02* (2013.01)

(58) Field of Classification Search
CPC .... E21B 47/024; E21B 47/122; E21B 49/003; E21B 4/02
(Continued)

(56) References Cited

U.S. PATENT DOCUMENTS 4,015,234 A 3/1977 Krebs
4,051,897 A 10/1977 Kingelin et al.
(Continued)

FOREIGN PATENT DOCUMENTS

WO 2011066624 6/2011
WO 2012003999 2/2013
(Continued)

OTHER PUBLICATIONS

Halliburton Energy Services, Geo-Pilot® GXT Rotary Steerable System, available at http://www.halliburton.com/en-US/ps/sperry/drilling/directional-drilling/rotary-steerables/geo-pilot-gxt-rotary-steerable-system.page, retrieved on Jul. 2, 2014, 1 page.
(Continued)

*Primary Examiner* — Naomi J Small
(74) *Attorney, Agent, or Firm* — Kilpatrick, Townsend & Stockton LLP

(57) ABSTRACT

A communication system for use in a wellbore can include a first cylindrically shaped band that can be positioned around a first outer housing of a first subsystem of a well tool. The first cylindrically shaped band can be operable to electromagnetically couple with a second cylindrically shaped band. The second cylindrically shaped band can be positioned around a second outer housing of a second subsystem of the well tool. The first cylindrically shaped band can electromagnetically couple with the second cylindrically shaped band via an electromagnetic field or by transmitting a current to the second cylindrically shaped band through a fluid in the wellbore.

18 Claims, 8 Drawing Sheets

(51) Int. Cl.
*E21B 47/024* (2006.01)
*E21B 49/00* (2006.01)
*E21B 4/02* (2006.01)

(58) Field of Classification Search
USPC ..... 340/854.6
See application file for complete search history.

(56) References Cited

U.S. PATENT DOCUMENTS

| | | | | |
|---|---|---|---|---|
| 4,693,534 | A | 9/1987 | Clark et al. | |
| 4,712,070 | A | 12/1987 | Clark et al. | |
| 4,766,442 | A | 8/1988 | Issenmann | |
| 4,770,034 | A | 9/1988 | Titchener et al. | |
| 4,785,247 | A | 11/1988 | Meador et al. | |
| 5,160,925 | A | 11/1992 | Dailey et al. | |
| 5,339,037 | A | 8/1994 | Bonner et al. | |
| 5,359,324 | A | 10/1994 | Clark et al. | |
| 5,394,141 | A | 2/1995 | Soulier | |
| 6,064,210 | A | 5/2000 | Sinclair et al. | |
| 6,392,561 | B1 | 5/2002 | Davies et al. | |
| 6,577,244 | B1 | 6/2003 | Clark et al. | |
| 6,727,827 | B1 * | 4/2004 | Edwards | E21B 47/122 340/854.9 |
| 6,926,098 | B2 | 8/2005 | Peter | |
| 7,098,802 | B2 | 8/2006 | Hall et al. | |
| 7,252,160 | B2 | 8/2007 | Dopf et al. | |
| 7,277,026 | B2 | 10/2007 | Hall et al. | |
| 7,303,007 | B2 | 12/2007 | Konschuh et al. | |
| 7,518,528 | B2 | 4/2009 | Price et al. | |
| 7,557,582 | B2 | 7/2009 | Moore et al. | |
| 7,565,936 | B2 | 7/2009 | Toffolo et al. | |
| 7,566,235 | B2 | 7/2009 | Bottos et al. | |
| 7,605,716 | B2 | 10/2009 | Peter et al. | |
| 7,730,968 | B2 | 6/2010 | Hosie et al. | |
| 8,011,425 | B2 | 9/2011 | Konschuh et al. | |
| 8,031,081 | B2 | 10/2011 | Pisoni et al. | |
| 8,102,276 | B2 | 1/2012 | Sugiura | |
| 8,242,928 | B2 | 8/2012 | Prammer | |
| 8,258,976 | B2 | 9/2012 | Price et al. | |
| 8,570,045 | B2 | 10/2013 | Tchakarov et al. | |
| 8,648,733 | B2 | 2/2014 | Dopf et al. | |
| 9,851,465 | B2 * | 12/2017 | Wang | G01V 3/00 |
| 2003/0137301 | A1 * | 7/2003 | Thompson | G01V 3/30 324/338 |
| 2004/0113808 | A1 | 6/2004 | Hall et al. | |
| 2005/0087368 | A1 | 4/2005 | Boyle et al. | |
| 2005/0218898 | A1 | 10/2005 | Fredette et al. | |
| 2006/0000604 | A1 | 1/2006 | Jenkins et al. | |
| 2006/0151179 | A1 | 7/2006 | Boyadjieff et al. | |
| 2008/0253228 | A1 | 10/2008 | Camwell et al. | |
| 2009/0045974 | A1 | 2/2009 | Patel | |
| 2010/0127708 | A1 * | 5/2010 | Bittar | E21B 47/026 324/339 |
| 2010/0170671 | A1 * | 7/2010 | Sihler | E21B 4/02 166/65.1 |
| 2010/0213942 | A1 * | 8/2010 | Lazarev | E21B 17/028 324/333 |
| 2011/0254695 | A1 | 10/2011 | Camwell et al. | |
| 2012/0160473 | A1 | 6/2012 | Sihler | |
| 2012/0199730 | A1 | 8/2012 | Chirovsky et al. | |
| 2012/0299743 | A1 * | 11/2012 | Price | E21B 17/028 340/854.6 |
| 2013/0088364 | A1 | 4/2013 | Bittar et al. | |
| 2013/0113487 | A1 | 5/2013 | Bittar et al. | |
| 2013/0319767 | A1 | 12/2013 | Wilson et al. | |
| 2014/0132271 | A1 | 5/2014 | Liu et al. | |
| 2014/0202768 | A1 | 7/2014 | Noske et al. | |
| 2014/0240141 | A1 | 8/2014 | Logan et al. | |
| 2015/0002307 | A1 * | 1/2015 | Graf | E21B 47/122 340/854.4 |

FOREIGN PATENT DOCUMENTS

| | | |
|---|---|---|
| WO | 2014015323 | 1/2014 |
| WO | 2014047543 | 3/2014 |
| WO | 2014071520 | 5/2014 |
| WO | 2014133504 | 9/2014 |
| WO | 2016099505 | 6/2016 |
| WO | 2016108811 | 7/2016 |

OTHER PUBLICATIONS

International Patent Application No. PCT/US2014/071112, International Search Report and Written Opinion, dated Aug. 26, 2015, 15 pages.

International Patent Application No. PCT/US2014/072496, International Search Report and Written Opinion, dated Sep. 1, 2015, 10 pages.

International Patent Application No. PCT/US2014/072507, International Search Report and Written Opinion, dated Sep. 21, 2015, 14 pages.

Reeves et al., "High Speed Acoustic Telemetry Network Enables Real-Time Along String Measurements, Greatly Reducing Drilling Risk", 2011, pp. 12.

Schlumberger Company , "PZIG At-bit inclination and gama ray service", available at http://www.slb.com/~/media/Files/drilling/product_sheets/mwd/pathfinder mwd/pzig_at_bit_gr_measurements_ps.pdf, retrieved on Apr. 4, 2017, 2 pages.

Scientific Drilling , "Sci-Driver Near Bit Smart Motor", available at http://scientificdrilling.com/content/uploads/2014/01/Product-Spec-Sheet_LWD_Sci-Driver_Smart-Motor.pdf, retrieved on Apr. 4, 2017, 1 page.

* cited by examiner

ELECTROMAGNETICALLY COUPLED BAND-GAP TRANSCEIVERS

CROSS-REFERENCE TO RELATED APPLICATIONS

This is a U.S. national phase under 35 U.S.C. 371 of International Patent Application No. PCT/US2014/072507, titled "Electromagnetically Coupled Band-Gap Transceivers" and filed Dec. 29, 2014, the entirety of which is incorporated herein by reference.

TECHNICAL FIELD

The present disclosure relates generally to devices for use in well systems. More specifically, but not by way of limitation, this disclosure relates to electromagnetically coupled band-gap transceivers.

BACKGROUND

A well system (e.g., an oil or gas well for extracting fluid or gas from a subterranean formation) can include various well tools in a wellbore. It can be desirable to communicate data between the well tools. In some examples, a cable can be used to transmit data between the well tools. The cable can wear or fail, however, as the well components rotate and vibrate to perform functions in the wellbore. In other examples, the well tools can wirelessly transmit data to each other. The power transmission efficiency of a wireless communication, however, can depend on a variety of factors that may be impractical or infeasible to control. For example, the power transmission efficiency of a wireless communication can depend on the conductive characteristics of the subterranean formation. It can be challenging to wirelessly communicate between well tools efficiently.

DETAILED DESCRIPTION

Figure 1:
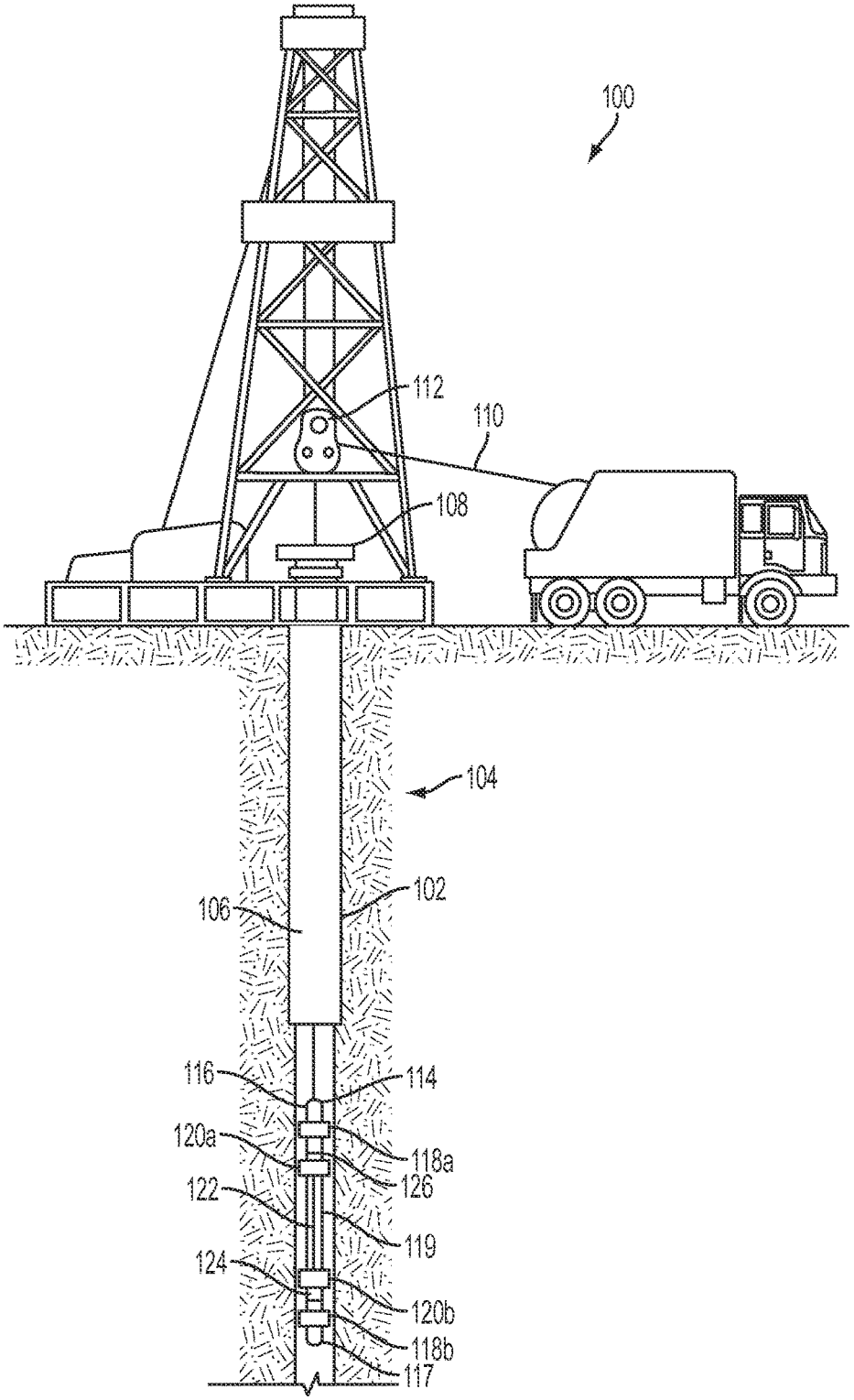
FIG. 1 depicts a well system that includes a system for using electromagnetically coupled band-gap transceivers according to one example.

Certain aspects and features of the present disclosure are directed to a communication system that includes electromagnetically coupled band-gap transceivers operable to transmit data between well tool components (e.g., subsystems) in a wellbore. The electromagnetically coupled band-gap transceivers can include a transceiver with a cylindrically shaped band positioned around (e.g., positioned coaxially around) a subsystem of the well tool. The electromagnetically coupled band-gap transceivers can also include another transceiver with a cylindrically shaped band positioned around another subsystem of the well tool.

The transceivers can electromagnetically communicate (e.g., wirelessly communicate using electromagnetic fields) with each other via the cylindrically shaped bands. For example, power can be supplied to the cylindrically shaped band of one transceiver. The power can generate a voltage between the cylindrically shaped band and the outer housing of the associated subsystem. The voltage can cause the cylindrically shaped band to emit an electromagnetic field through a fluid in the wellbore and the surrounding formation (e.g., the subterranean formation). The voltage can also cause the cylindrically shaped band to transmit current into the fluid in the wellbore and the surrounding formation. If the fluid and formation have a high resistivity, the current transmitted into the fluid and formation can attenuate and the other transceiver can detect the electromagnetic field emitted by the transceiver. If the fluid and formation have a low resistivity, the electromagnetic field emitted by the transceiver can attenuate and the other transceiver can detect the current transmitted through the fluid and the formation. In this manner, the transceivers can wirelessly communicate (e.g., wirelessly couple) in low resistivity and high resistivity downhole environments.

In some examples, the cylindrical shape of the bands can improve the power transmission efficiency of the communication system. For example, the one subsystem may rotate at a different speed and in a different direction than another subsystem. If the transceivers use, for example, asymmetrically-shaped electrodes positioned on the subsystems, the electrodes can rotate out of alignment with each other due to the differing speeds and directions of rotation of the subsystems. When the electrodes are misaligned, electromagnetic communications between the electrodes may not be effective because the signal received by the misaligned transceiver may not be detected properly. This can cause unexpected fluctuations in the strength of the received signals during the rotation of the subsystem, which can reduce the signal detection efficiency of the communication system. Conversely, the cylindrically shaped bands cannot rotate out of alignment with one another, because each of the cylindrically shaped bands traverses the entire circumference of its associated subsystem. This can allow wireless communications to travel shorter distances and without interference from the well tool. This can improve the signal detection efficiency of the communication system and provide for a more stable communication system.

In some examples, an intermediate subsystem can be positioned between the transceivers. Because the intermediate subsystem can be long (e.g., 40 feet or more), the distance between the transceivers may cause electromagnetic communications between the transceivers to attenuate. This can affect the power transmission efficiency of the communication system.

To reduce the attenuation due to the distance between the transceivers, in some examples, two couplers can be positioned on the intermediate subsystem. Each of the couplers can include a cylindrically shaped band positioned around the intermediate subsystem. One coupler can be positioned near (e.g., within one foot of) a longitudinal end of the intermediate subsystem and proximate to one of the transceivers. The proximity of the coupler to the transceiver can allow the transceiver to electromagnetically transmit a signal to the coupler with low signal attenuation. The coupler can receive the signal and transmit the signal via a conductor (e.g., a wire) to the other coupler. The other coupler can be positioned near the opposite longitudinal end of the intermediate subsystem and proximate to the other transceiver. The proximity of the other coupler to the other transceiver can allow the other coupler to electromagnetically transmit the signal to the other transceiver with low signal attenuation. By communicating via the couplers (rather than one transceiver directly electromagnetically communicating with the other transceiver), the communication system can have an improved power transmission efficiency.

In one example, the well tool can include a logging-while-drilling tool and the intermediate subsystem can include a mud motor. One of the transceivers can electromagnetically (e.g., wirelessly) transmit data to a coupler positioned at one longitudinal end of the mud motor. For example, the transceiver can electromagnetically transmit data associated with a drilling shock, a vibration, the temperature of the drill bit, a rotation speed of a motor, and an inclination angle of the drill bit to the coupler. The coupler can receive the data and transmit the data via a conductor to the other coupler positioned at the opposite longitudinal end of the mud motor. The other coupler can electromagnetically transmit the data to the other transceiver. In this manner, the transceivers can communicate across the mud motor via the couplers.

In some examples, improving the power transmission efficiency can reduce the power consumed by the communication system. This can increase the lifespan of the transceivers (which can operate on battery power). Improving the power transmission efficiency can also improve the signal-to-noise ratio of signals communicated between the transceivers. This can enhance the quality of the signals and reduce errors in data associated with (e.g., derived from) the signals.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts a well system 100 that includes electromagnetically coupled band-gap transceivers 118*a*, 118*b* according to one example. The well system 100 includes a wellbore 102 extending through various earth strata. The wellbore 102 extends through a hydrocarbon bearing subterranean formation 104. A casing string 106 extends from the surface 108 to the subterranean formation 104. The casing string 106 can provide a conduit through which formation fluids, such as production fluids produced from the subterranean formation 104, can travel from the wellbore 102 to the surface 108.

The well system 100 can also include at least one well tool 114 (e.g., a formation-testing tool). The well tool 114 can be coupled to a wireline, slickline, or coiled tube 110 that can be deployed into the wellbore 102, for example, using a winch 112.

The well tool 114 can include a transceiver 118*a* positioned on a subsystem 116. The transceiver 118*a* can include a transducer positioned on the subsystem 116. The transducer can include a cylindrically shaped band or one or more electrodes. For example, the transducer can include multiple electrodes positioned around the outer circumference of the subsystem 116. As another example, the transducer can include a cylindrically shaped band positioned coaxially around the subsystem 116. The transducer can include any suitable conductive material (e.g., stainless steel, lead, copper, or titanium).

The well tool 114 can also include another transceiver 118*b* positioned on another subsystem 117. The transceiver 118*b* can include a transducer positioned on the subsystem 117. For example, the transducer can include a cylindrically shaped band positioned coaxially around the outer circumference of the subsystem 117. In some examples, the transceivers 118*a*, 118*b* can directly electromagnetically communicate with each other.

In some examples, the well tool 114 can also include a coupler 120*a* positioned at or near (e.g., within 1 foot of) a longitudinal end 124 of an intermediate subsystem 119. The well tool 114 can include another coupler 120*b* positioned at or near an opposing longitudinal end 126 of the intermediate subsystem 119. Each of the couplers 120*a*, 120*b* can include a transducer positioned on the intermediate subsystem 119. For example, each of the couplers 120*a*, 120*b* can include cylindrically shaped bands positioned coaxially around the outer circumference of the intermediate subsystem 119. The transducers of the couplers 120*a*, 120*b* can include the same conductive material or a different conductive material from the transducers of the transceivers 118*a*, 118*b*.

The couplers 120*a*, 120*b* can be electrically coupled by a conductor 122. The conductor 122 can include a wire. The wire can be insulated. The conductor 122 can positioned within a housing of the intermediate subsystem 119. For example, the wire can be within the inner diameter of, or embedded within the structure of, the housing of the intermediate subsystem 119. The conductor 122 can traverse the longitudinal length of the intermediate subsystem 119.

The transceiver 118*a* can electromagnetically couple with the coupler 120*a*. The other transceiver 118*b* can electromagnetically couple with the other coupler 120*b*. This can form a communication path between the transceivers 118*a*, 118*b*. For example, the transceiver 118*a* can electromagnetically transmit data (e.g., wirelessly transmit data using electromagnetic fields) to the coupler 120*a*. The coupler 120*a* can receive the data and transmit the data via the conductor 122 to the other coupler 120*b*. The other coupler 120*b* can electromagnetically transmit the data to the other transceiver 118*b*. In this manner, the transceiver 118*a* can transmit data to the other transceiver 118*b* via the couplers 120*a*, 120*b*. As another example, the transceiver 118*b* can electromagnetically transmit data to the coupler 120*b*. The coupler 120*b* can receive the data and transmit the data via the conductor 122 to the other coupler 120*a*. The other coupler 120*a* can electromagnetically transmit the data to the other transceiver 118*a*. The transceiver 118*a* can receive the data and, for example, communicate the data uphole via wireline. In this manner, the transceiver 118*b* can transmit data to the other transceiver 118*a* via the couplers 120*a*, 120*b*.

In some examples, an object can be positioned between the one or more of the subsystems 116, 117, 119. The object can be fluid, another well tool, a component of the well tool 114, a portion of the subterranean formation 104, etc. The wireless coupling of the transceiver 118*a* with the coupler 120*a*, and the other transceiver 118*b* with the other coupler 120*b*, can allow for a communication path between the transceivers 118*a*, 118*b* that may otherwise be blocked by the object. For example, this communication path may not be possible in traditional wired communications systems, because the object may block a wire from passing between the subsystems 116, 117, 119.

In some examples, one or more of the subsystems 116, 117, 119 can rotate with respect to each other. The wireless coupling of the transceiver 118*a* with the coupler 120*a*, and the other transceiver 118*b* with the other coupler 120*b*, can generate a communication path between the transceivers 118*a*, 118*b*. This communication path may not be possible in a traditional wired communications system, because the rotation of the subsystems 116, 117, 119 may sever the wire or otherwise prevent the wire from passing between the subsystems 116, 117, 119.

Figure 2:
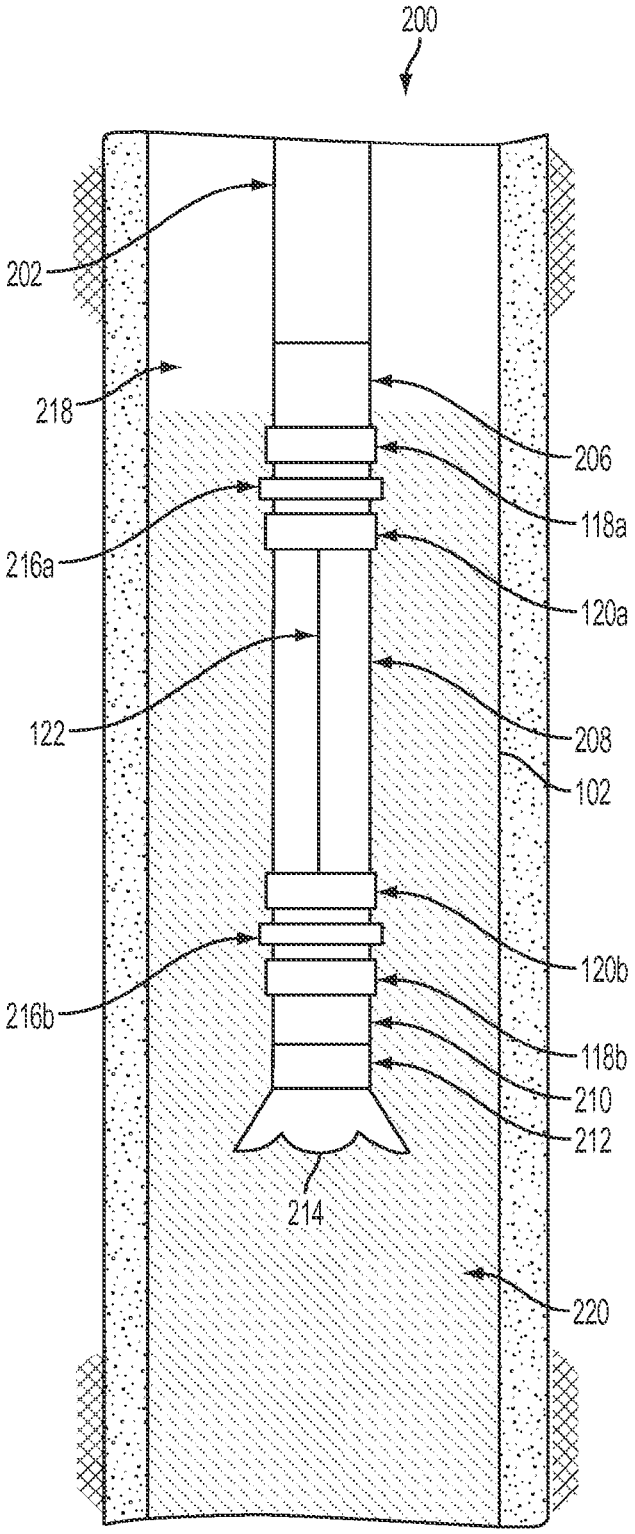
FIG. 2 depicts another well system that includes a system for using electromagnetically coupled band-gap transceivers according to one example.

FIG. 2 depicts another well system 200 that includes a system for using electromagnetically coupled band-gap transceivers 118*a*, 118*b* according to one example. In this example, the well system 200 includes a wellbore 102. A well tool 202 (e.g., logging-while-drilling tool) can be positioned in the wellbore 102. The well tool 202 can include various subsystems 206, 208, 210, 212. For example, the well tool 202 can include a subsystem 206 that can include a communication subsystem. The well tool 202 can also include a subsystem 210 that can include a saver subsystem or a rotary steerable system. A tubular section or an intermediate subsystem 208 (e.g., a mud motor or measuring-while-drilling module) can be positioned between the other subsystems 206, 210. In some examples, the well tool 202 can include a drill bit 214 for drilling the wellbore 102. The drill bit 212 can be coupled to another tubular section or subsystem 212 (e.g., a measuring-while-drilling module or a rotary steerable system).

The well tool 202 can also include tubular joints 216*a*, 216*b*. Tubular joint 216*a* can prevent a wire from passing between a subsystem 206 and the intermediate subsystem 208. Tubular joint 216*b* can prevent a wire from passing between a subsystem 210 and the intermediate subsystem 208.

The wellbore 102 can include fluid 220. The fluid 220 can flow in an annulus 218 positioned between the well tool 202 and a wall of the wellbore 102. In some examples, the fluid 220 can contact the transceivers 118*a*, 118*b* and the couplers 120*a*, 120*b*. This contact can allow for electromagnetic communication, as described in greater detail with respect to FIG. 3B.

One transceiver 118*a* can be coupled to one subsystem 206 and the other transceiver 118*b* can be coupled to another subsystem 210. One coupler 120*a* can be positioned at or near a longitudinal end of the intermediate subsystem 208 and proximate to a transceiver 118*a* (e.g., for electromagnetically communicating with the transceiver 118*a*). The other coupler 120*b* can be positioned at or near an opposing longitudinal end of the intermediate subsystem 208 and proximate to the other transceiver 118*b* (e.g., for electromagnetically communicating with the other transceiver 118*b*). A conductor 122 can electrically couple the coupler 120*a* with the other coupler 120*b*.

In some examples, one transceiver 118*a* can directly electromagnetically communicate with the other transceiver 118*b*. In other examples, the one transceiver 118*a* can indirectly communicate with the other transceiver 118*b* via the couplers 120*a*, 120*b*. This can improve the overall power transmission efficiency of the communication system (e.g., the transceivers 118*a*, 118*b* and couplers 120*a*, 120*b*). For example, one transceiver 118*a* can transmit a wireless signal to an associated coupler 120*a*. Because the distance between the transceiver 118*a* and the coupler 120*a* can be small (e.g., 1 foot or less), there can be low attenuation of the wireless signal. The coupler 120*a* can receive the wireless signal, convert the wireless signal into an electrical signal, and transmit the electrical signal via a wire to the other coupler 120*b*. There may be minimal attenuation of the electrical signal because the electrical signal is transmitted via the wire. The other coupler 120*b* can receive the electrical signal, convert the electrical signal to a wireless signal, and transmit the wireless signal to the other transceiver 118*b*. Because the distance between the other coupler 120*b* and the other transceiver 118*b* can be small, there can be low attenuation of the wireless signal. In this manner, one transceiver 118*a* can indirectly communicate with the other transceiver 118*b* via the couplers 120*a*, 120*b* to improve the power transmission efficiency of the communication system.

Figure 3A:
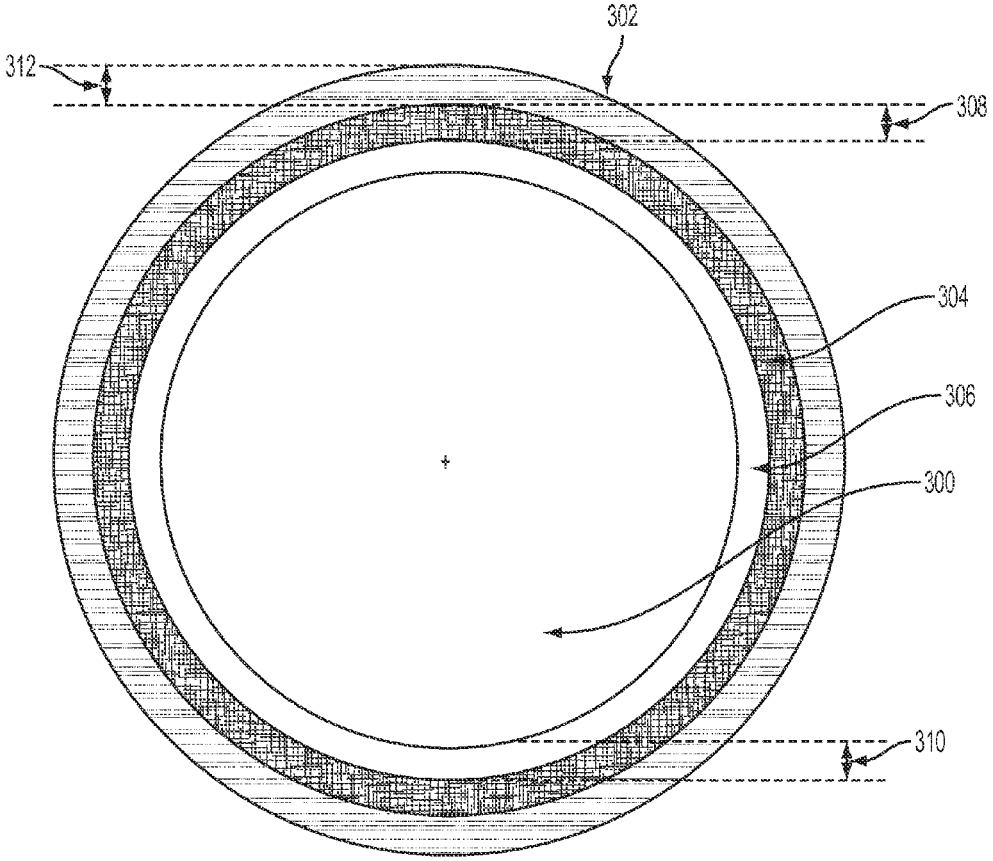
FIG. 3A is a cross-sectional end view of a transducer for use with a transceiver or a coupler according to one example.

FIG. 3A is a cross-sectional end view of a transducer 302 for use with a transceiver or a coupler according to one example. In this example, the transducer 302 includes a cylindrically shaped band. The transducer 302 can be positioned around a well tool 300 (e.g., the housing 306 of the well tool 300). In some examples, an insulator 304 can be positioned between the transducer 302 and the housing 306 of the well tool 300. This can prevent the transducer 302 from conducting electricity directly to the well tool 300. The insulator 304 can include any suitable electrically insulating material (e.g., rubber, PEEK, or plastic).

The diameter of the transducer 302 can be larger than the diameter of the housing 306 of the well tool 300. For example, the diameter of the transducer 302 can be 4.75 inches and the diameter of the housing 306 of the well tool 300 can be 3.2 inches. In some examples, the thickness 312 of the transducer 302 can be thicker or thinner than the thickness 310 of the insulator 304, the thickness 310 of the housing 306 of the well tool 300, or both. For example, the transducer 302 can have a thickness 312 of 0.2 inches.

In some examples, as the length (e.g., length 311 depicted in FIG. 3B) of the transducer 302 increases, the power transmission efficiency can increase. Space limitations (e.g., due to the configuration of the well tool 300), however, can limit the length of the transducer 302. In some examples, the length of the transducer 302 can be the maximum feasible length in view of space limitations. For example, the length of the transducer 302 can be 6 inches. The length of the insulator 304 can be the same as or greater than the length of the transducer 302.

In some examples, each of the transducers 302 in the communication system can have characteristics (e.g., the length, thickness, and diameter) that are the same as or different from one another. For example, the transceivers can include transducers 302 with different diameters from one another. As another example, the couplers can include transducers 302 with different diameters from one another.

Figure 3B:
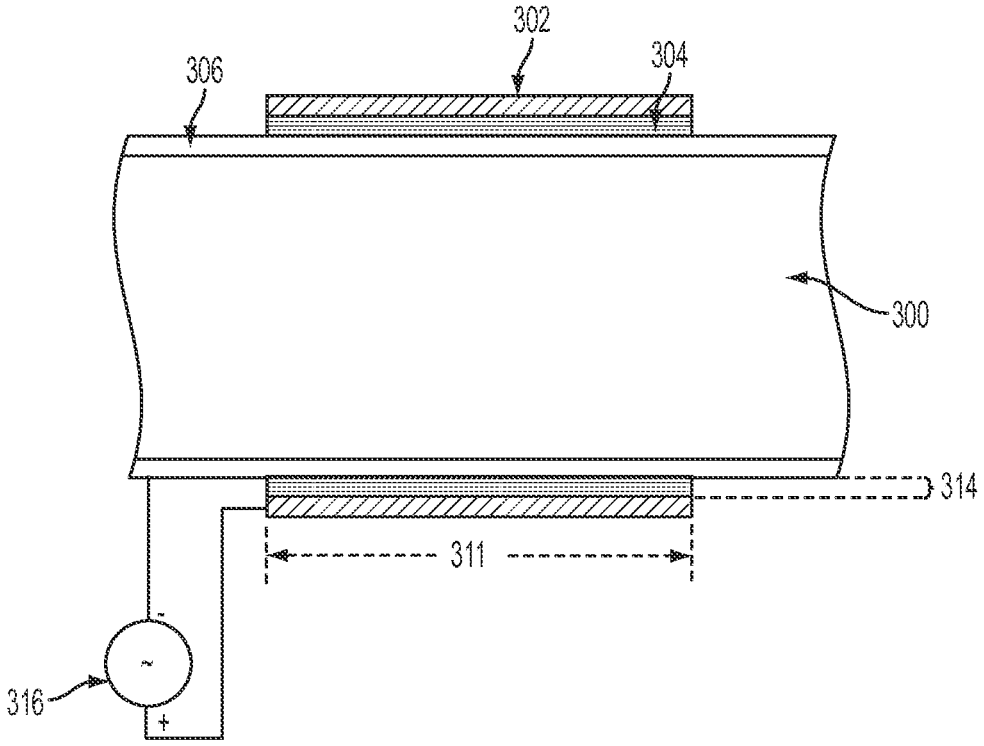
FIG. 3B is a cross-sectional side view of the transducer of FIG. 3A for use with a transceiver or a coupler according to one example.

FIG. 3B is a cross-sectional side view of the transducer 302 of FIG. 3A for use with a transceiver or a coupler according to one example. In some examples, the transceiver can apply electricity to the transducer 302 to transmit an electromagnetic signal. For example, the transceiver can include an AC signal source 316. The positive lead of the AC signal source 316 can be coupled to the transducer 302 and the negative lead of the AC signal source 316 can be coupled to the housing 306 of the well tool 300. The AC signal source 316 can generate a voltage 314 between the transducer 302 and the housing 306 of the well tool 300.

The voltage 314 can cause the transducer 302 to transmit an electromagnetic field through a fluid in the wellbore and the formation (e.g., the subterranean formation). The voltage 314 can also cause the cylindrically shaped band to transmit current into the fluid in the wellbore and the formation. If the fluid and formation have a high resistivity, the current can attenuate and the electromagnetic field can propagate through the fluid and formation with a high power transmission efficiency. This can generate a wireless coupling that is primarily in the form of an electromagnetic field. If the fluid and formation have a low resistivity, the electromagnetic field can attenuate and the current can propagate through the fluid and formation with a high power transmission efficiency. This can generate a wireless coupling that is primarily in the form of current flowing through the fluid and formation.

The combination of the electromagnetic field and current can allow the transducer 302 to wirelessly communicate (e.g., wirelessly couple) with another transducer 302 in both low resistivity and high resistivity downhole environments. Further, the combination of the electromagnetic field and current can allow the transducer 302 can transfer the voltage 314 between the transducer 302 and the housing 306 to another transducer 302. This voltage-based wireless coupling can be different from traditional wireless communications systems, which may use coil-based induction for wireless communication.

Figure 4:
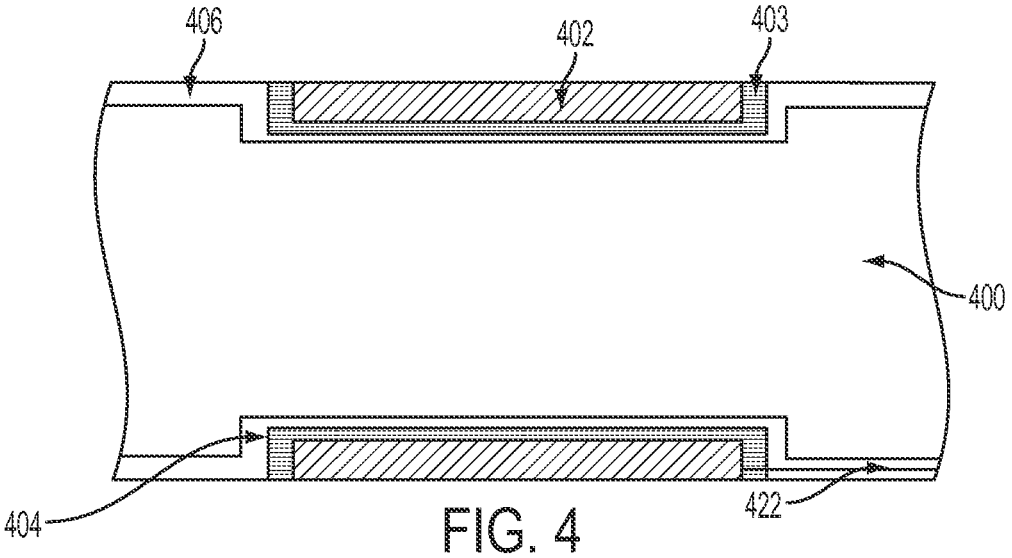
FIG. 4 is a cross-sectional side view of a transducer for use with a transceiver or a coupler according to one example.

FIG. 4 is a cross-sectional side view of a transducer 402 for use with a transceiver or a coupler according to one example. In some examples, the housing 406 of the well tool 400 can include a recessed area 404. The transducer 402 can be positioned within the recessed area 404. An insulator 403 can be positioned within the recessed area 404 and between the transducer 402 and the housing 406 of the well tool 400.

In some examples, a conductor 422 (e.g., a wire, insulated wire, or any suitable conductive material) can electrically couple the transducer 402 to another transducer 402. The conductor 422 can be embedded within the housing 406 of the well tool 400. In some examples, the conductor 422 can be positioned inside of (e.g., within the inner diameter of) the housing 406 of the well tool 400 or positioned outside of the housing 406 of the well tool 400.

Figure 5:
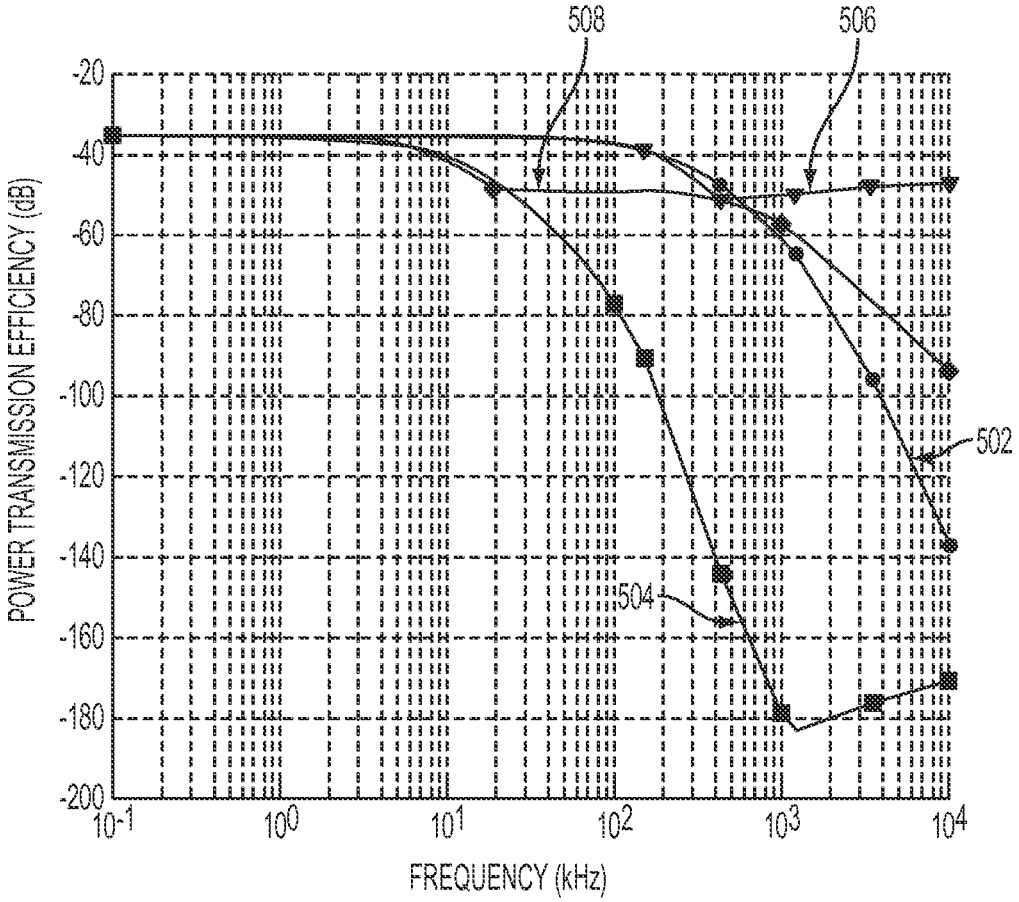
FIG. 5 is a graph depicting power transmission efficiencies using electromagnetically coupled band-gap transceivers according to one example.

FIG. 5 is a graph depicting power transmission efficiencies using electromagnetically coupled band-gap transceivers according to one example. In some examples, obstacles in the transmission path of an electromagnetic communication can affect the power transmission efficiency of the electromagnetic communication. For example, the conductivity of a fluid (and the conductivity of the subterranean formation) in the transmission path of a electromagnetic communication can affect the power transmission efficiency of the electromagnetic communication. FIG. 5 depicts examples of power transmission efficiencies when the transmission path has a high resistivity (e.g., 20 ohm-m) and when the transmission path has a low resistivity (e.g., 1 ohm-m).

For example, line 502 depicts an example of power transmission efficiencies using direct electromagnetic communication between transceivers when the transmission path includes a high resistivity. Line 504 depicts an example of power transmission efficiencies using direct electromagnetic communication between transceivers when the transmission path includes a low resistivity. Line 506 depicts an example of power transmission efficiencies using indirect electromagnetic communication between transceivers (e.g., communication via the couplers) when the transmission path includes a high resistivity. Line 508 depicts an example of power transmission efficiencies using indirect electromagnetic communication between transceivers when the transmission path includes a low resistivity.

Using the couplers can improve the power transmission efficiency (e.g., at frequencies greater than 150 kHz), both when the transmission path has a low resistivity and when the transmission path has a high resistivity. This can reduce the power consumed by the transceivers, which can increase the lifespan of the transceivers (which can operate on battery power). In some examples, improving the power transmission efficiency can also improve the signal-to-noise ratio of the transmitted signals. This can enhance the quality of the transmitted signals and reduce errors in data associated with (e.g., derived from) the transmitted signals.

Figure 6:
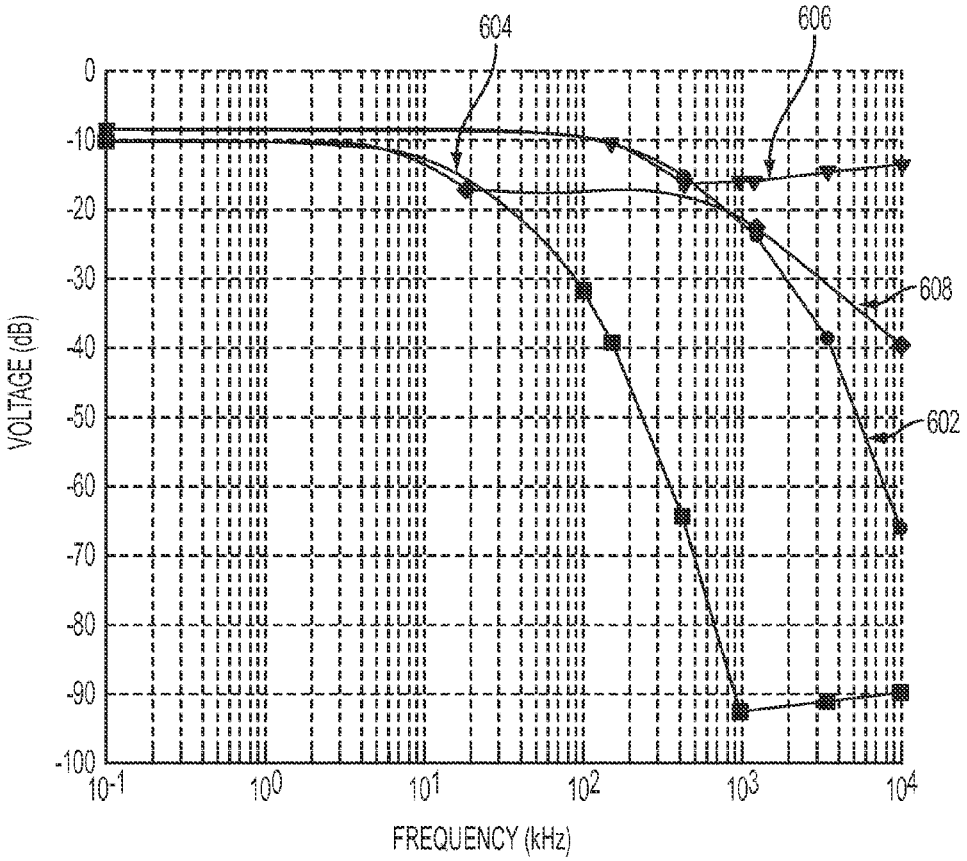
FIG. 6 is a graph depicting voltages received using an electromagnetically coupled band-gap transceiver according to one example.

FIG. 6 is a graph depicting voltages received using an electromagnetically coupled band-gap transceiver according to one example. Line 602 depicts voltages of received electromagnetic signals when using direct electromagnetic communication between transceivers and when the transmission path includes a high resistivity. Line 604 depicts voltages of received electromagnetic signals when using direct electromagnetic communication between transceivers and when the transmission path includes a low resistivity. Line 606 depicts voltages of received electromagnetic signals when using indirect electromagnetic communication (e.g., communication via the couplers) when the transmission path includes a high resistivity. Line 608 depicts voltages of received electromagnetic signals when using indirect electromagnetic communication when the transmission path includes a low resistivity. Using indirect electromagnetic communication, the transceivers can receive electromagnetic signals with higher voltages at higher frequencies (e.g., frequencies greater than 1 MHz) than when using direct electromagnetic communication. This can occur both when the transmission path has a low resistivity and when the transmission path has a high resistivity.

Figure 7:
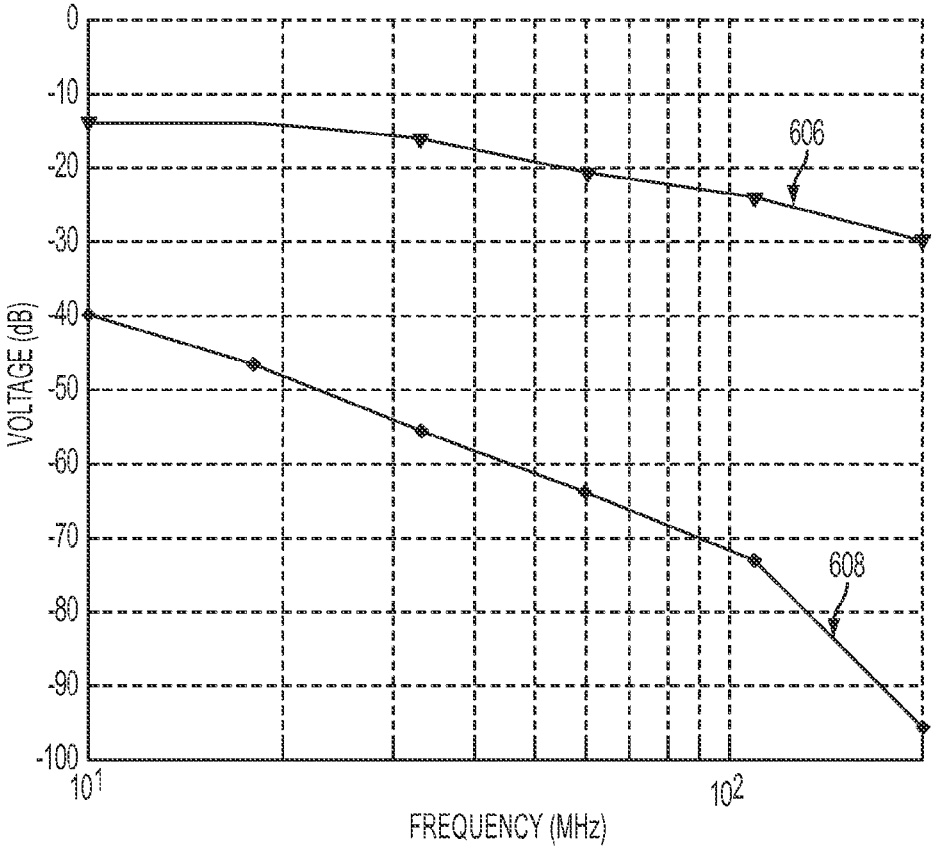
FIG. 7 is graph depicting voltages associated with electromagnetic transmissions using electromagnetically coupled band-gap transceivers according to one example.

In some examples, the minimal voltage level to receive a recognizable electromagnetic communication (e.g., an electromagnetic communication that is not too noisy) can be −30 dB. As shown in FIG. 6, using indirect electromagnetic communication, the transmission frequency of a recognizable electromagnetic communication can be 3 MHz or higher when communicated through a transmission path with a low resistivity. As shown by line 606 of FIG. 7, using indirect electromagnetic communication, the transmission frequency of a recognizable electromagnetic communication can higher than 200 MHz when communicated through a high resistivity transmission path. In some examples, by being able to transmit recognizable electromagnetic communications at high frequencies, the transceivers can communicate more data (e.g., more than 30 bps) in shorter periods of time.

Figure 8:
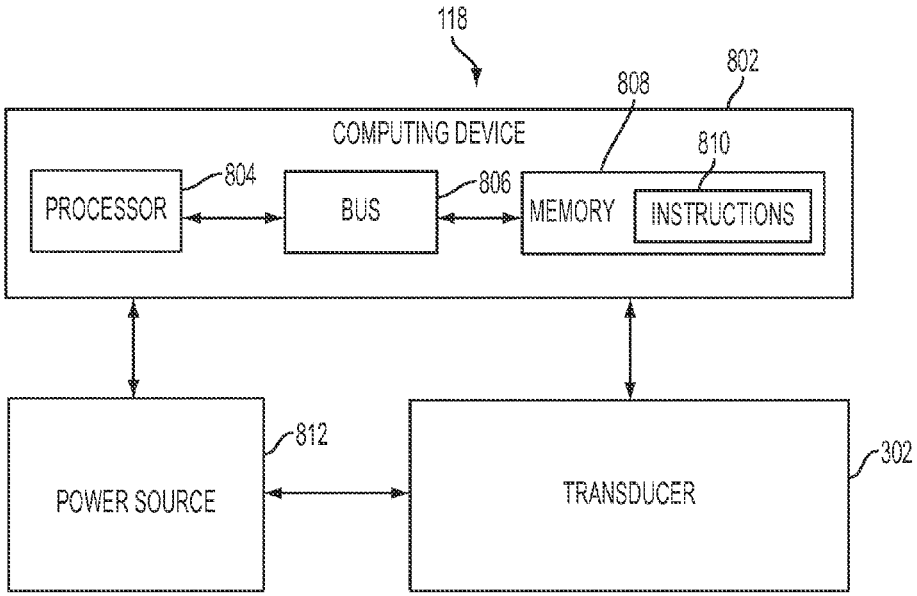
FIG. 8 is a block diagram of a band-gap transceiver that can electromagnetically couple according to one example.

FIG. 8 is a block diagram of an example of a band-gap transceiver 118 that can electromagnetically couple according to one example. In some examples, the components shown in FIG. 8 (e.g., the computing device 802, power source 812, and transducer 302) can be integrated into a single structure. For example, the components can be within a single housing. In other examples, the components shown in FIG. 8 can be distributed (e.g., in separate housings) and in electrical communication with each other.

The electromagnetically coupled band-gap transceiver 118 can include a computing device 802. The computing device 802 can include a processor 804, a memory 808, and a bus 806. The processor 804 can execute one or more operations for operating the electromagnetically coupled band-gap transceiver 118. The processor 804 can execute instructions 810 stored in the memory 808 to perform the operations. The processor 804 can include one processing device or multiple processing devices. Non-limiting examples of the processor 804 include a Field-Programmable Gate Array ("FPGA"), an application-specific integrated circuit ("ASIC"), a microprocessor, etc.

The processor 804 can be communicatively coupled to the memory 808 via the bus 806. The non-volatile memory 808 may include any type of memory device that retains stored information when powered off. Non-limiting examples of the memory 808 include electrically erasable and programmable read-only memory ("EEPROM"), flash memory, or any other type of non-volatile memory. In some examples, at least some of the memory 808 can include a medium from which the processor 804 can read the instructions 810. A computer-readable medium can include electronic, optical, magnetic, or other storage devices capable of providing the processor 804 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions may include processor-specific instructions generated by a compiler or an interpreter from code written in any suitable computer-programming language, including, for example, C, C++, C#, etc.

The electromagnetically coupled band-gap transceiver 118 can include a power source 812. The power source 812 can be in electrical communication with the computing device 802 and the transducer 302. In some examples, the power source 812 can include a battery (e.g. for powering the electromagnetically coupled band-gap transceiver 118). In other examples, the electromagnetically coupled band-gap transceiver 118 can be coupled to and powered by an electrical cable (e.g., a wireline).

Additionally or alternatively, the power source 812 can include an AC signal generator. The computing device 802 can operate the power source 812 to apply a transmission signal to the transducer 302. For example, the computing device 802 can cause the power source 812 to apply a modulated series of voltages to the transducer 302. The modulated series of voltages can be associated with data to be transmitted to another transducer 302 (e.g., a transducer 302 associated with a coupler or another electromagnetically coupled band-gap transceiver 118). The other transducer 302 can receive the modulated series of voltages and transmit the data to still another transducer 302. In other examples, the computing device 802, rather than the power source 812, can apply the transmission signal to the transducer 302.

The electromagnetically coupled band-gap transceiver 118 can include a transducer 302. As described above, a voltage can be applied to the transducer 302 (e.g., via power source 812) to cause the transducer 302 to transmit data to another transducer 302 (e.g., a transducer 302 associated with a coupler).

In some examples, the transducer 302 can receive a wireless transmission. The transducer 302 can communicate data (e.g., voltages) associated with the wireless transmission to the computing device 802. In some examples, the computing device 802 can analyze the data and perform one or more functions. For example, the computing device 802 can generate a response based on the data. The computing device 802 can cause a response signal associated with the response to be transmitted to the transducer 302. The transducer 302 can communicate the response to another electromagnetically coupled band-gap transceiver 118. In this manner, the computing device 802 can receive, analyze, and respond to communications from another electromagnetically coupled band-gap transceiver 118.

Figure 9:
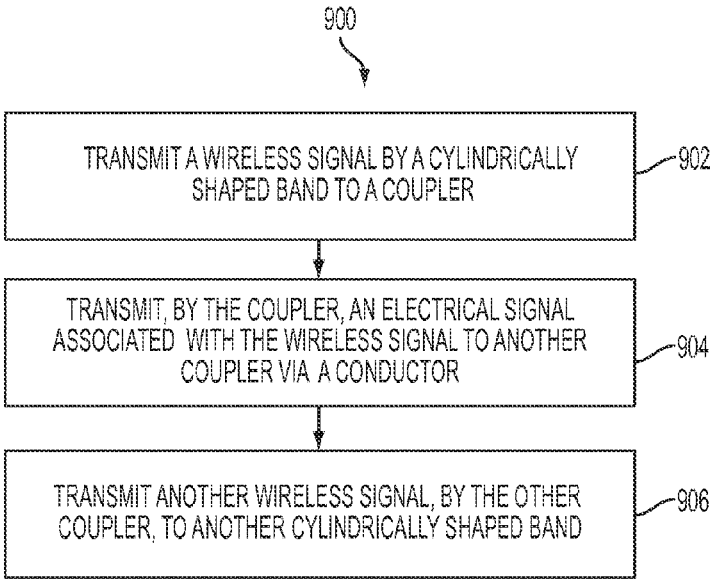
FIG. 9 is a flow chart showing an example of a process for using electromagnetically coupled band-gap transceivers according to one example.

FIG. 9 is a flow chart showing an example of a process for using electromagnetically coupled band-gap transceivers according to one example.

In block 902, a cylindrically shaped band transmits a wireless signal (e.g., an electromagnetic signal) to a coupler. The cylindrically shaped band can be positioned around a subsystem of a well tool. The coupler can be positioned around (e.g., positioned coaxially around an outer housing of) and at a longitudinal end of an intermediate subsystem of the well tool. In some examples, the cylindrically shaped band can emit an electromagnetic field to transmit the wireless signal. In other examples, the cylindrically shaped band can apply current to a fluid and the formation to transmit the wireless signal.

In block 904, the coupler can transmit an electrical signal associated with the wireless signal to another coupler via a conductor (e.g., a wire). The other coupler can be positioned around (e.g., positioned coaxially around an outer housing of) and at another longitudinal end of the intermediate subsystem of the well tool. The conductor can be inside, outside, or embedded within the intermediate subsystem (e.g., within the housing of the subsystem).

In block 906, the other coupler can transmit another wireless signal (e.g., a wireless signal associated with the electrical signal) to another cylindrically shaped band. The cylindrically shaped band can be positioned around another subsystem of the well tool. The cylindrically shaped band can receive the wireless signal. In some examples, the cylindrically shaped band can transmit the received wireless signal to a computing device, another well tool subsystem, and/or uphole.

In some aspects, a system for electromagnetically coupled band-gap transceivers is provided according to one or more of the following examples:

Example #1

A communication system for use in a wellbore can include a first cylindrically shaped band. The first cylindrically shaped band can be positioned around a first outer housing of a first subsystem of a well tool. The first cylindrically shaped band can be operable to electromagnetically couple with a second cylindrically shaped band via an electromagnetic field and/or by transmitting a current to the second cylindrically shaped band through a fluid in the wellbore. The second cylindrically shaped band can be positioned around a second outer housing of a second subsystem of the well tool.

Example #2

The communication system of Example #1 may feature the first cylindrically shaped band being operable to electromagnetically couple with the second cylindrically shaped band via the electromagnetic field in response to a resistivity of the fluid being below a threshold. The first cylindrically shaped band may be further operable to electromagnetically couple with the second cylindrically shaped band via the current transmitted through the fluid in response to the resistivity of the fluid being above the threshold.

Example #3

The communication system of any of Examples #1-2 may feature the second subsystem including a mud motor. The first cylindrically shaped band and the second cylindrically shaped band can be positioned for electromagnetically coupling across a tubular joint positioned between the first subsystem and the mud motor.

Example #4

The communication system of any of Examples #1-3 may feature a mud motor being positioned between the first subsystem and the second subsystem. The first cylindrically shaped band can be operable to electromagnetically communicate with the second cylindrically shaped band across the mud motor.

Example #5

The communication system of any of Examples #1-4 may feature the second cylindrically shaped band being coupled to a longitudinal end of the second subsystem and to a conductor embedded within the second outer housing. The conductor can be coupled to a third cylindrically shaped band positioned around the second outer housing and at an opposing lateral end of the second subsystem.

Example #6

The communication system of any of Examples #1-5 may feature a third cylindrically shaped band being operable to electromagnetically couple with a fourth cylindrically shaped band positioned around a third outer housing of a third subsystem of the well tool.

Example #7

The communication system of any of Examples #1-6 may feature an insulator being positioned between the first cylindrically shaped band and the first outer housing of the first subsystem.

Example #8

The communication system of any of Examples #1-7 may feature the second outer housing of the second subsystem including a recessed area. The second cylindrically shaped band can be positioned within the recessed area.

Example #9

The communication system of any of Examples #1-8 may feature an insulator being positioned within the recessed area and between the second cylindrically shaped band and the second outer housing.

Example #10

An assembly may include a well tool. The assembly may also include a first cylindrically shaped band positioned around an outer housing and at a longitudinal end of a subsystem of the well tool. The first cylindrically shaped band operable to electromagnetically couple with a transceiver. The assembly may further include a second cylindrically shaped band positioned around the outer housing and at an opposite longitudinal end of the subsystem. The second cylindrically shaped band can be operable to electromagnetically couple with another transceiver. The first cylindrically shaped band can be coupled to the second cylindrically shaped band by a conductor.

Example #11

The assembly of Example #10 may feature the first cylindrically shaped band being operable to electromagnetically couple with the transceiver via an electromagnetic field in response to a resistivity of a fluid in a wellbore being below a threshold. The first cylindrically shaped band may also be operable to electromagnetically couple with the transceiver via a current transmitted through the fluid in response to the resistivity of the fluid being above the threshold.

Example #12

The assembly of any of Examples #10-11 may feature the conductor being embedded within the outer housing.

Example #13

The assembly of any of Examples #10-12 may feature the subsystem including a mud motor. The first cylindrically shaped band can be positioned for electromagnetically coupling across a tubular joint positioned between the mud motor and another subsystem.

Example #14

The assembly of any of Examples #10-13 may feature an insulator being positioned between the first cylindrically shaped band and the outer housing.

Example #15

The assembly of any of Examples #10-14 may feature the outer housing including a recessed area. The first cylindrically shaped band can be positioned within the recessed area.

Example #16

The assembly of any of Examples #10-15 may feature an insulator being positioned within a recessed area and between the first cylindrically shaped band and the outer housing.

Example #17

A method can include transmitting an electromagnetic signal, by a cylindrically shaped band, to a coupler positioned around an outer housing and at a longitudinal end of a subsystem of a well tool. The method can also include transmitting, by the coupler, an electrical signal associated with the electromagnetic signal to another coupler via a wire. The other coupler can be positioned around the outer housing and at another longitudinal end of the subsystem. The method can further include transmitting another electromagnetic signal, by the other coupler, to another cylindrically shaped band positioned around another subsystem of the well tool.

Example #18

The method of Example #17 may feature the outer housing including a recessed area. The coupler can be positioned within the recessed area.

Example #19

The method of any of Examples #17-18 may feature an insulator being positioned within a recessed area and between the coupler and the outer housing. The wire can be embedded in the outer housing.

Example #20

The method of any of Examples #17-19 may feature the subsystem including a mud motor. The cylindrically shaped band and the coupler can be positioned for electromagnetically coupling across a tubular joint positioned between the cylindrically shaped band and the coupler.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A communication system for use in a wellbore, the communication system comprising:

a first cylindrically shaped band positioned around a first outer housing of a first subsystem of a well tool, wherein the first cylindrically shaped band is operable to electromagnetically couple with a second cylindrically shaped band positioned around a second outer housing of a second subsystem of the well tool via an electromagnetic field or by transmitting a current to the second cylindrically shaped band through a fluid in the wellbore, wherein the second cylindrically shaped band is coupled to a longitudinal end of the second subsystem and to a conductor embedded within the second outer housing, wherein the conductor is coupled to a third cylindrically shaped band positioned around the second outer housing and at an opposing lateral end of the second subsystem.

2. The communication system of claim 1, wherein the first cylindrically shaped band is operable to (i) electromagnetically couple with the second cylindrically shaped band via the electromagnetic field in response to a resistivity of the fluid being below a threshold and (ii) electromagnetically couple with the second cylindrically shaped band via the current transmitted through the fluid in response to the resistivity of the fluid being above the threshold.

3. The communication system of claim 1, wherein the second subsystem comprises a mud motor, and wherein the first cylindrically shaped band and the second cylindrically shaped band are positioned for electromagnetically coupling across a tubular joint positioned between the first subsystem and the mud motor.

4. The communication system of claim 1, wherein the third cylindrically shaped band is operable to electromagnetically couple with a fourth cylindrically shaped band positioned around a third outer housing of a third subsystem of the well tool.

5. The communication system of claim 1, wherein an insulator is positioned between the first cylindrically shaped band and the first outer housing of the first subsystem.

6. The communication system of claim 1, wherein the second outer housing of the second subsystem comprises a recessed area, and wherein the second cylindrically shaped band is positioned within the recessed area.

7. The communication system of claim 6, wherein an insulator is positioned within the recessed area and between the second cylindrically shaped band and the second outer housing.

8. An assembly comprising:

a well tool;

a first cylindrically shaped band positioned around an outer housing and at a longitudinal end of a subsystem of the well tool, the first cylindrically shaped band operable to electromagnetically couple with a transceiver; and a second cylindrically shaped band positioned around the outer housing and at an opposite longitudinal end of the subsystem, the second cylindrically shaped band operable to electromagnetically couple with another transceiver, wherein the first cylindrically shaped band is coupled to the second cylindrically shaped band by a conductor.

9. The assembly of claim 8, wherein the first cylindrically shaped band is operable to (i) electromagnetically couple with the transceiver via an electromagnetic field in response to a resistivity of a fluid in a wellbore being below a threshold and (ii) electromagnetically couple with the transceiver via a current transmitted through the fluid in response to the resistivity of the fluid being above the threshold.

10. The assembly of claim 8, wherein the conductor is embedded within the outer housing.

11. The assembly of claim 8, wherein the subsystem comprises a mud motor, and wherein the first cylindrically shaped band is positioned for electromagnetically coupling across a tubular joint positioned between the mud motor and another subsystem.

12. The assembly of claim 8, wherein an insulator is positioned between the first cylindrically shaped band and the outer housing.

13. The assembly of claim 8, wherein the outer housing comprises a recessed area, and wherein the first cylindrically shaped band is positioned within the recessed area.

14. The assembly of claim 13, wherein an insulator is positioned within the recessed area and between the first cylindrically shaped band and the outer housing.

15. A method comprising:

transmitting an electromagnetic signal, by a cylindrically shaped band, to a coupler positioned around an outer housing and at a longitudinal end of a subsystem of a well tool;

transmitting, by the coupler, an electrical signal associated with the electromagnetic signal to another coupler via a wire, wherein the other coupler is positioned around the outer housing and at another longitudinal end of the subsystem; and transmitting another electromagnetic signal, by the other coupler, to another cylindrically shaped band positioned around another subsystem of the well tool.

16. The method of claim 15, wherein the outer housing comprises a recessed area, and wherein the coupler is positioned within the recessed area.

17. The method of claim 16, wherein an insulator is positioned within the recessed area and between the coupler and the outer housing, and wherein the wire is embedded in the outer housing.

18. The method of claim 15, wherein the subsystem comprises a mud motor, and wherein the cylindrically shaped band and the coupler are positioned for electromagnetically coupling across a tubular joint positioned between the cylindrically shaped band and the coupler.

* * * * *